US005472117A

United States Patent [19]

Geiser et al.

[11] Patent Number: 5,472,117

[45] Date of Patent: Dec. 5, 1995

[54] FLOW FACILITATION AND CONTROL SYSTEM AND RELATED METHOD

[75] Inventors: Richard L. Geiser, Goshen; John W. Marttila, Milford, both of Ind.

[73] Assignee: CTB, Inc., Milford, Ind.

[21] Appl. No.: 132,499

[22] Filed: Oct. 5, 1993

[51] Int. Cl.[6] ..... B65D 88/66

[52] U.S. Cl. ..... 222/1; 222/200; 222/185.1

[58] Field of Search ..... 222/1, 185, 196, 222/198, 199, 200, 564, 185.1

[56] References Cited

U.S. PATENT DOCUMENTS

| | | | |
|---|---|---|---|
| 2,174,348 | 9/1939 | Damond | 222/196 |
| 3,232,486 | 2/1966 | Ofner | 222/196 X |
| 3,407,972 | 10/1968 | Cymbalisty | 222/196 |
| 3,575,321 | 4/1971 | Fisher et al. . | |
| 3,751,991 | 8/1973 | Fisher et al. . | |
| 3,773,231 | 11/1973 | Wahl | 222/199 X |
| 3,853,247 | 12/1974 | Wahl | 222/199 |
| 3,863,811 | 2/1975 | Fisher et al. | 222/145 |
| 3,920,116 | 11/1975 | Butler | 198/128 |
| 3,973,703 | 8/1976 | Peschl | 222/199 |
| 4,030,633 | 6/1977 | Fisher | 222/1 |
| 4,034,898 | 7/1977 | Marttila et al. | 222/228 |
| 4,228,822 | 10/1980 | Fisher . | |
| 4,285,447 | 8/1981 | Fairbank | 222/200 |
| 4,483,625 | 11/1984 | Fisher | 366/297 |
| 4,548,342 | 10/1985 | Fisher | 222/145 |
| 4,560,285 | 12/1985 | Fisher | 366/341 |
| 4,601,414 | 7/1986 | Lawson | 222/564 |

FOREIGN PATENT DOCUMENTS

| | | | |
|---|---|---|---|
| 2343671 | 11/1977 | France | 222/196 |
| 2913758 | 10/1980 | Germany | 222/196 |
| 674348 | 5/1990 | Switzerland | 222/200 |
| 923913 | 4/1982 | U.S.S.R. | 222/196 |
| 1230926 | 5/1986 | U.S.S.R. | 222/196 |
| 1359324 | 4/1972 | United Kingdom | 222/199 |
| 2084969 | 4/1982 | United Kingdom | 222/198 |
| 2110194 | 6/1983 | United Kingdom | 222/196 |

OTHER PUBLICATIONS

Gaylord, *Design Of Steel Bins For Storage Of Bulk Solids*, 1984.

Sinden, *Getting "Difficult" Materials Out Of Bins*, 1961.

*Primary Examiner*—Kevin P. Shaver

*Attorney, Agent, or Firm*—Trexler, Bushnell, Giangiorgi & Blackstone, Ltd.

[57] ABSTRACT

Apparatus and a related method for facilitating and controlling the flow within, and out of a particulate matter bulk storage facility is provided. The apparatus includes a pre-shaped member, preferably in the form of a substantially impermeable plate, held within the storage facility, in a substantially horizontal orientation, above a discharge port. The pre-shaped member is of a predetermined size and shape and is located at a predetermined height above the discharge port. A vibrator unit is attached to the pre-shaped member and preferably supplied with power transmitted through a flexible conduit which does not restrict the motion of the vibrator/pre-shaped member combination. Operation of the vibrator causes the pre-shaped member to oscillate thereby creating moving voids and shock waves within the stored material which promotes an even velocity profile across the storage facility and produces a mass flow unloading pattern. The system minimizes bridging, coring, arching and ratholing, supports a central core of the stored material above the discharge port, and significantly reduces normal weight forces acting on adjoining material transport equipment.

31 Claims, 4 Drawing Sheets

FLOW FACILITATION AND CONTROL SYSTEM AND RELATED METHOD

BACKGROUND OF THE INVENTION a. Field of the Invention

In general, the present invention relates to storage facilities, and especially the bulk storage of granular and/or powdered materials. More particularly, the present invention pertains to promoting mass flow when unloading the storage facility: by minimizing common bulk storage problems such as bridging, coring, arching and ratholing; and by creating a more effective flow pattern within the storage facility. Reduction of the forces associated with the stored material in the vicinity of the discharge port also contributes to the effectiveness of the system.

b. Description of Related Prior Art

Numerous past attempts have been made at improving the unloading of particulate material stored in bulk storage facilities. As a result of many factors including heat, weight, pressure and moisture, stored particulate matter such as grain or powder often compacts and agglomerates, for example, along the side walls of a storage facility thereby creating static zones, and detrimentally effecting the unloading of the storage facility. These static zones of material, in combination with bottom unloading of the material through a discharge port, often produces a funneling or ratholing effect causing and maintaining the separation of the material ingredients and the incomplete purging of the storage facility. The introduction of new material into the bulk storage facility can consequently establish an undesirable last-in, first-out flow pattern.

Of the above-discussed storage problems, perhaps the most common is a phenomenon known as "bridging" whereby a natural arch of material forms over the discharge opening, which arch has sufficient strength to hold back the material remaining in the storage facility and prevent it from flowing through the exhaust port.

Another significant problem with the unloading of granular and/or powdered material from a bulk storage facility results from the weight forces of the material acting at the point of discharge. It is not uncommon, for example, for a bulk storage facility to be directly coupled to a material transport system for carrying the material away from the bulk storage facility by use of an auger, conveyer belt, etc. Concentration of the material weight forces at the transport system entry, however, greatly increases the power required to drive the auger, conveyor belt, etc. In addition, the material weight forces can result in clogging the system, or causing some other malfunction.

In severe cases, the forces associated with any or all of the above-discussed material storage problems have caused vibration, deformation and even collapse of the bulk storage facility.

Objects and Summary of the Invention

It is a general objective of the present invention to positively encourage the unloading of stored material from a bulk storage facility in a controlled manner.

It is a related objective to create mass flow unloading of the storage facility.

It is an associated objective to support the weight of the central core of the stored material over the discharge outlet of the storage facility.

It is a more detailed objective to create a controlled material flow pattern within the storage facility above the discharge outlet thereby effectively increasing the size of the discharge area.

Another objective is to minimize the segregation of stored material ingredients and promote the remixing of material ingredients that do become segregated.

It is a related objective to provide an even velocity profile across the storage facility during unloading.

It is a connected objective to provide a smooth, even pattern of material discharge from the storage facility into an associated material transport system.

An additional objective is to achieve the above goals without significantly decreasing the storage volume of the bulk storage facility.

Yet another objective is to reduce the possibility of deforming or otherwise damaging the bulk storage facility during unloading.

Still another objective is to provide a method of achieving a first-in, first-out material flow pattern for unloading the bulk storage facility.

Other objects and advantages of the invention will become apparent upon reading the following detailed description, and upon reference to the drawings. Throughout the description, like reference numerals refer to like parts.

Summarily stated, the present invention comprises apparatus and a related method for facilitating and controlling the flow of stored material within and out of a bulk storage facility during unloading, said apparatus comprising a substantially impermeable pre-shaped member held within said storage facility, in a substantially horizontal orientation; above a discharge port, such that the weight of a central core of the stored material is supported thereby, and a vibrator unit operatively attached to said pre-shaped member for selectively oscillating said preshaped member to promote the unloading of the stored material from the discharge port.

BRIEF DESCRIPTION OF THE DRAWINGS

The features of the present invention which are believed to be novel are set forth with particularity in the appended claims. The organization and manner of operation of the invention together with further objects and advantages thereof may best be understood by reference to the following descriptions taken in connection with the accompanying drawings, in which:

DETAILED DESCRIPTION OF THE PREFERRED EMBODIMENT

While the invention will be described in connection with a preferred embodiment, it will be understood that it is not intended to limit the invention to that embodiment. On the contrary, it is intended to cover all alternatives, modifications and equivalents as may be included within the spirit and scope of the invention.

Furthermore, it should be noted at the outset that the present invention will be described in connection with a bulk storage facility for granular material, but that it is clearly not intended to be limited to such an application. Rather, the present invention can be used to achieve the objects discussed in a variety of particulate matter bulk storage facilities including the bulk storage of powdered materials.

Figure 1:
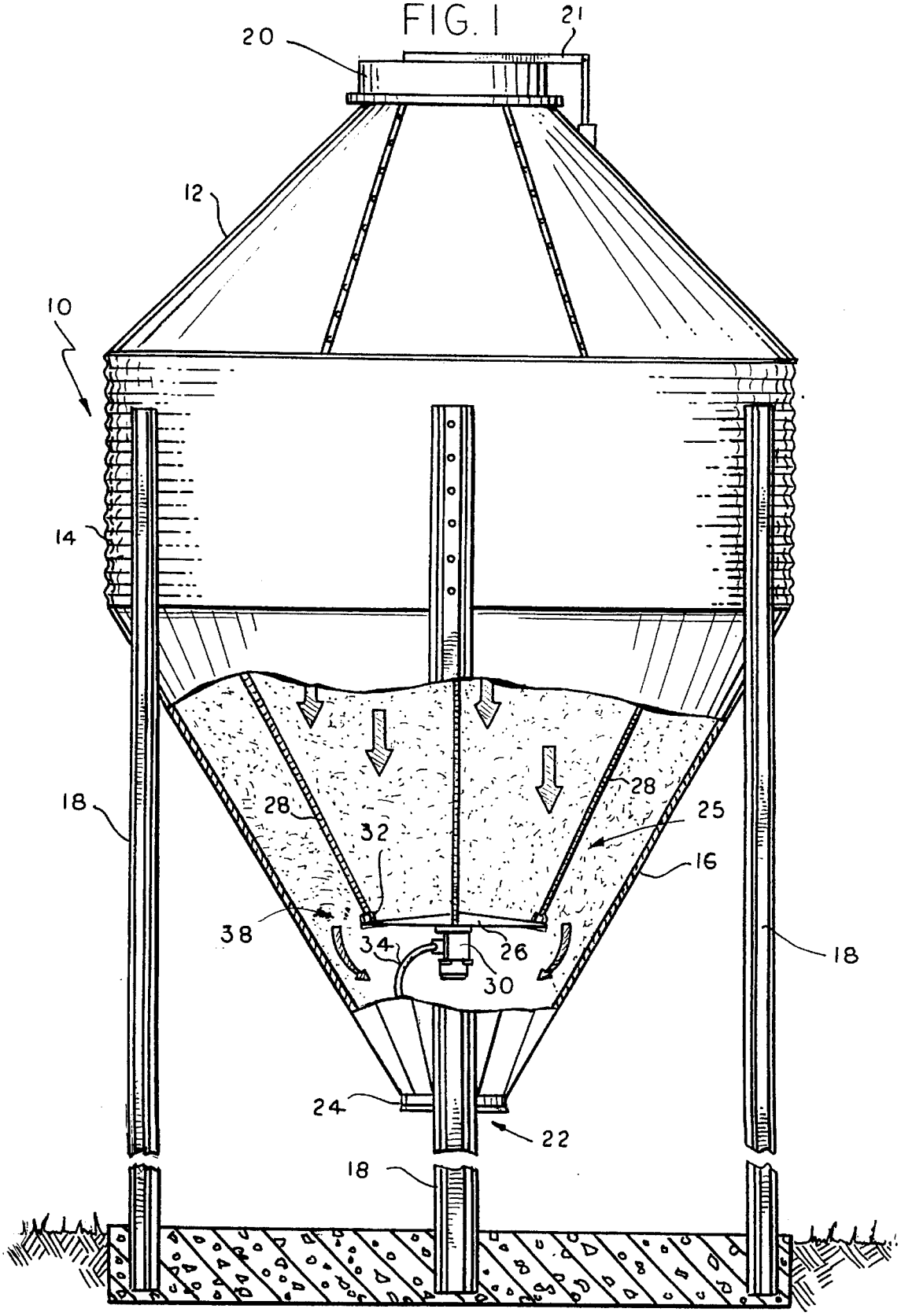
FIG. 1 is a side elevational view of a material storage facility, partially broken-away, equipped with one embodiment of the system of the present invention.

Turning now to FIG. 1, there is shown an example of a bulk storage facility in the form of a combination cylindrical-conical hopper 10. Of course, the storage facility can be constructed in many shapes and sizes, the combination cylindrical-conical hopper 10 illustrated being only one type. For example, rectangular shaped hoppers are also very common and fully applicable to the invention disclosed herein.

The illustrated hopper 10 includes a cylindrical portion 14, integrally formed with a lower funnel portion 16, and is supported by legs 18. In addition, the cylindrical portion 14 is attached to an upper cone-shaped member 12 having a top 20 equipped with a closure mechanism 21. The hopper 10 also includes a discharge port 22 at its lowest point for discharging grain into an associated material transport system (not shown) which typically mates with the hopper 10 at a collar 24 surrounding the discharge port 22. The hopper 10 is available in a variety of sizes and is commonly constructed of corrugated sheet metal.

The flow facilitation and control system 25 of the present invention, in the illustrated embodiment, is first shown to include a substantially impermeable pre-shaped member, such as a solid plate 26 held substantially horizontal in the hopper 10. As shown best in FIG. 1, preferably the plate 26 is suspended horizontally by flexible links 28 from the cylindrical portion 14, and a vibrator unit 30 is attached to the underside of the plate 26. Accordingly, the grain flow pattern through the hopper 10 is downward through the top 20, around the substantially solid plate member 26, and out of the discharge port 22 as illustrated by the arrows shown in FIG. 1. Once again, it is important to note that the present invention is not intended to be limited to the embodiment shown. The pre-shaped member, for example, can be designed in a variety of shapes as long as it is substantially impermeable to the stored material and mounted so as to be capable supporting the weight of a central core of the stored material. Similarly, the pre-shaped member, such as the plate 26, can be held in position within the hopper 10 by means other than the flexible links 28 shown in the preferred embodiment, without departing from the scope of the invention.

As illustrated, placement of the plate 26 creates a grain flow in an annular area 38 between the walls of the funnel portion 16 and the plate 26. The annular grain flow pattern continues downward along the walls of the funnel 16 and through a void and low pressure area created below the substantially impermeable plate 26, and then out of the discharge port 22. The creation of this annular flow pattern, in combination with the selective vibration of the plate 26, and supports 28, as described below, promotes an even unloading of the grain within the hopper 10, which is known in the industry as mass flow. Advantages of the mass flow pattern created include less feed material ingredient separation, promotion of material mixing between inner and outer zones of stored material, and a first-in, first-out unloading pattern, with no significant-decrease in the storage volume of the hopper 10. It is important to note that the plate 26 mounted as shown supports the weight forces of the grain core over the discharge port 22 thereby creating a void and low pressure area therebelow and reducing the normal forces acting on the operation of a material transport system (not shown) into which the grain is typically delivered.

Figure 2:
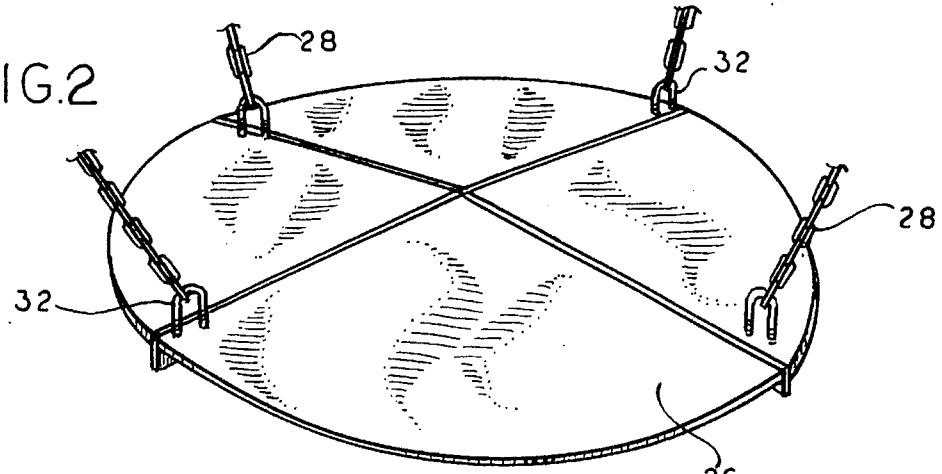
FIG. 2 is an isolated top perspective view of a preferred embodiment of the pre-shaped member component of the invention.

Referring now to the preferred embodiment in more detail and turning to FIG. 2, it can be understood that the plate 26 shown is in the form of a shallow cone-like member. The plate 26 should have a minimum angle related to the angle of repose of the granular material stored in the hopper 10 sufficient to prevent an accumulation of grain thereon, but a maximum angle less than that which would cause a wedging action of the grain between the plate 26 and the side walls of the funnel 16. The angle of repose of most feed materials commonly stored in the type of hopper discussed herein is in the range of 10°–45°. Thus, the angle of the plate member 26 should be within 0°–40° to achieve the result discussed.

It is also preferred that the diameter of the plate 26 be equal to or greater than the minimum arching or coring diameter of the granular material stored, but less than or equal to approximately 35% of the hopper diameter. For example, with a 9 foot diameter hopper, the diameter of the plate 26 should be no more than approximately 3.15 feet. If the plate diameter becomes too large, it causes an undesirable wedging action of the grain at the bin wall. Alternatively, if the plate diameter is too small, or if it is not mounted substantially horizontal, it will not function to support the weight of the central core of the stored material, nor create the desired void and low pressure below the plate 26 and above the discharge port 22. Accordingly, while the invention is not limited to a plate 26 as shown, any design utilized should be substantially impermeable, of sufficient size and strength, and orientated so as to achieve these functions.

Further, it is suggested that the height at which the plate 26 is suspended in the funnel 16 be determined by comparing the area of the plate 26 with an annular area 38 remaining between the plate 26 and the walls of the funnel 16. Optimally, the height of suspension should be at the point at which the area of the plate 26 is equal to the annular area 38 remaining (FIG. 1), or within 25% thereof. If, for example, a 30" diameter plate 26 is used, the area of the plate 26 may be approximately 706.5 square inches. Therefore, the plate should be suspended such that the area of annular area 38 is between approximately 530 square inches and 883 square inches.

Figure 3:
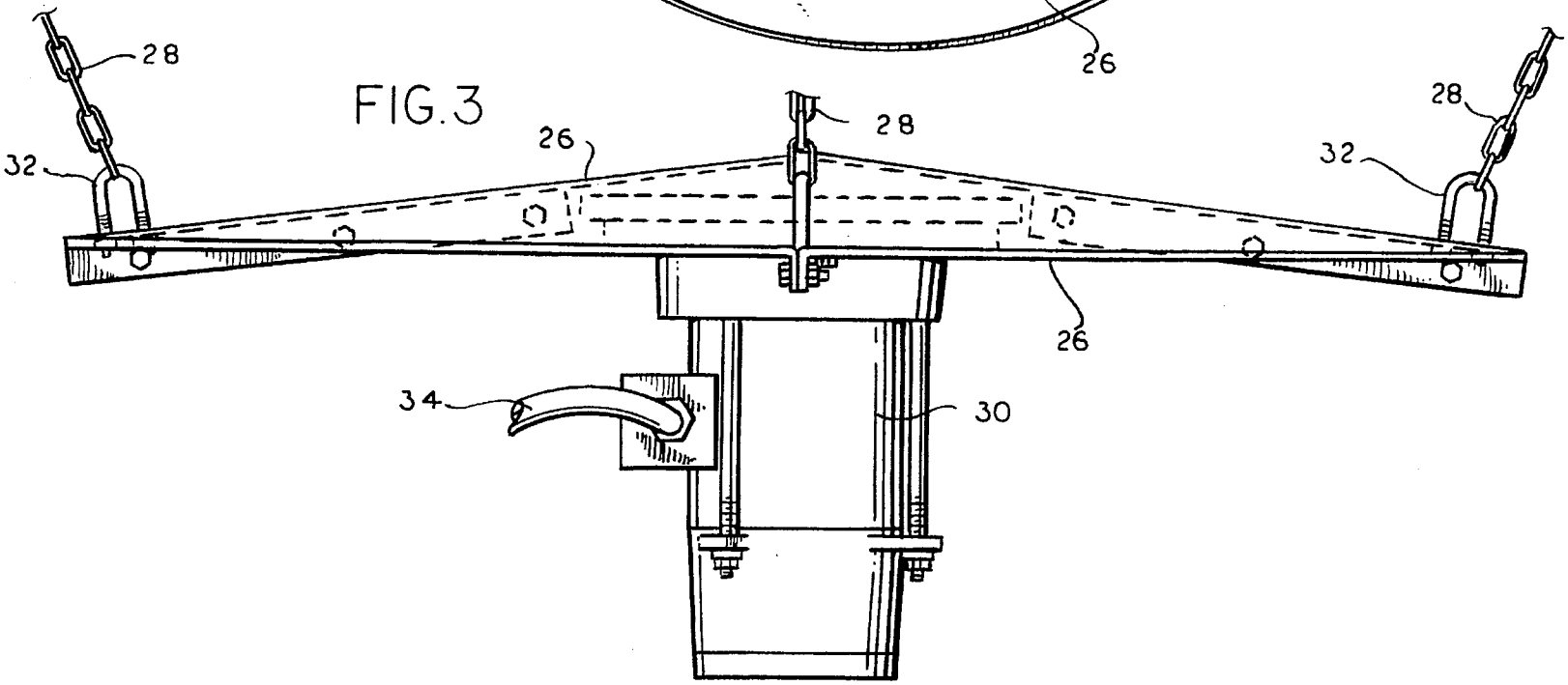
FIG. 3 is an isolated front elevational view of the pre-shaped member shown in FIG. 2 in combination with one form of a vibrator unit of the present invention.

As best illustrated in FIGS. 1–3, the plate 26 is suspended at the appropriate height in the funnel 16 by means of multiple, equally spaced, flexible link supports 28 attached to the plate 26, and to the hopper 10 (above the funnel section 16) with U-bolts or some other suitable brackets 32. The number of supports 28 required is usually three, four, or five, depending on the diameter of the hopper 10. Utilizing pure-tension supports such as cables or chains, as shown, to construct the flexible link supports 28 accomplishes two primary functions. First, the forces transmitted to the hopper 10 through the brackets 32 in this manner are kept to a minimum. And secondly, self-damping of the plate 26 and vibrator 30 combination is reduced when the combination is operated to promote mass flow as described in more detail below.

Further, mounting the plate 26 in the hopper 10, as described, from above, distributes the forces acting on the plate 26 over a larger surface area and causes the plate 26 to naturally remain centered over the discharge outlet 22 of the hopper 10. As such, the structural integrity of the hopper 10 is not at risk, and the angle of the supports 28 is slightly less than the angle of the funnel walls. As discussed above, however, it is contemplated that the plate 26 can be held in position in the hopper 10 by other alternative means, such as by an appropriate support from below.

Figure 4:
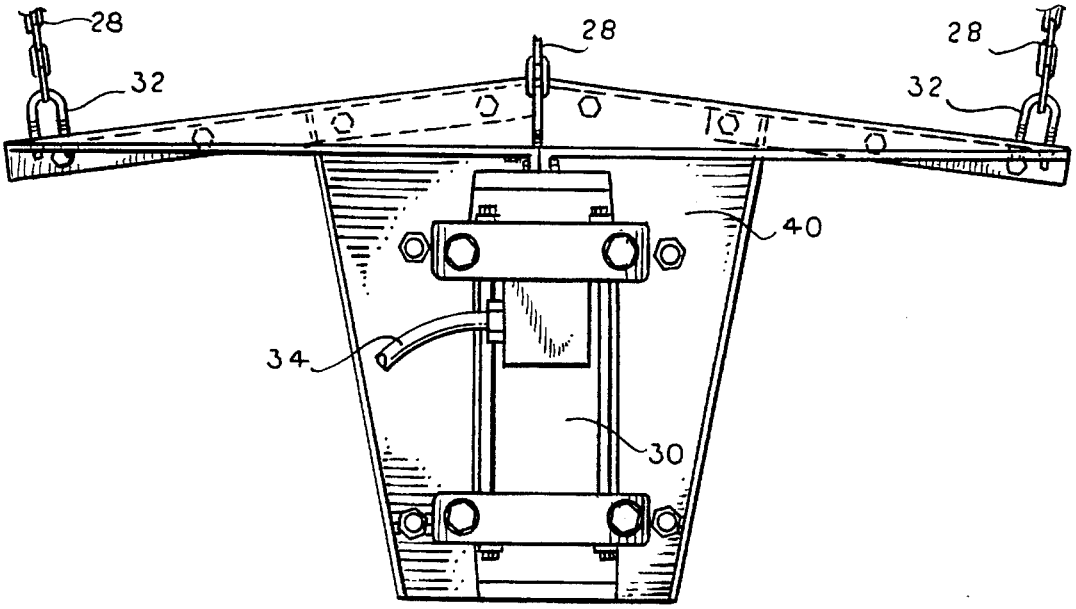
FIG. 4 is a view similar to FIG. 3, but illustrating an optional gusset-mount for the vibrator unit component.
Figure 5:
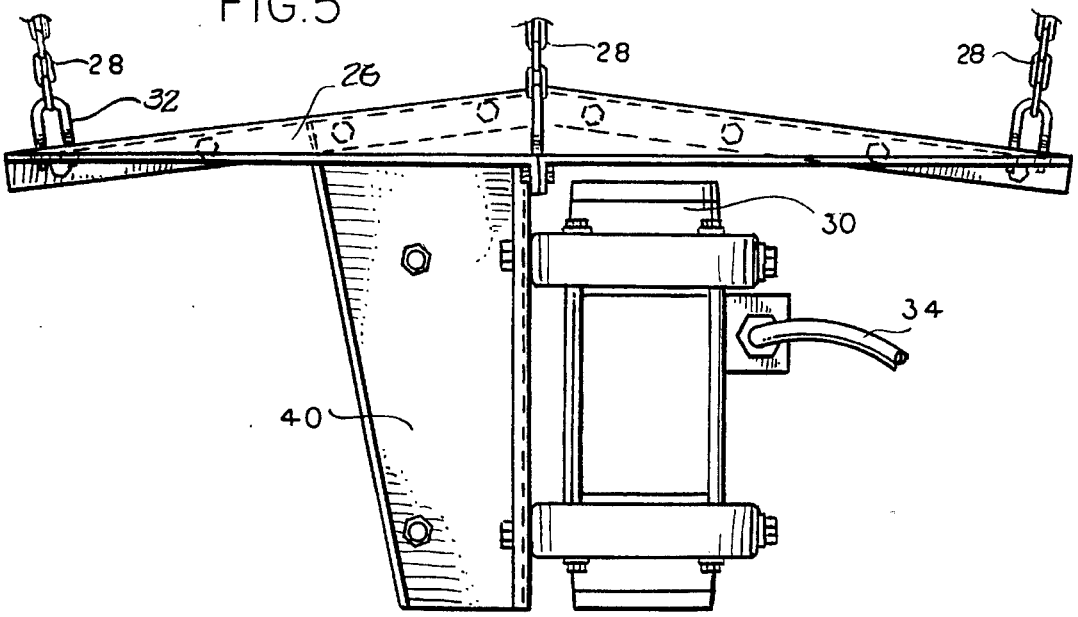
FIG. 5 is a side view of the alternative embodiment illustrated in FIG. 4.
Figures 6, 7, 8, 9:
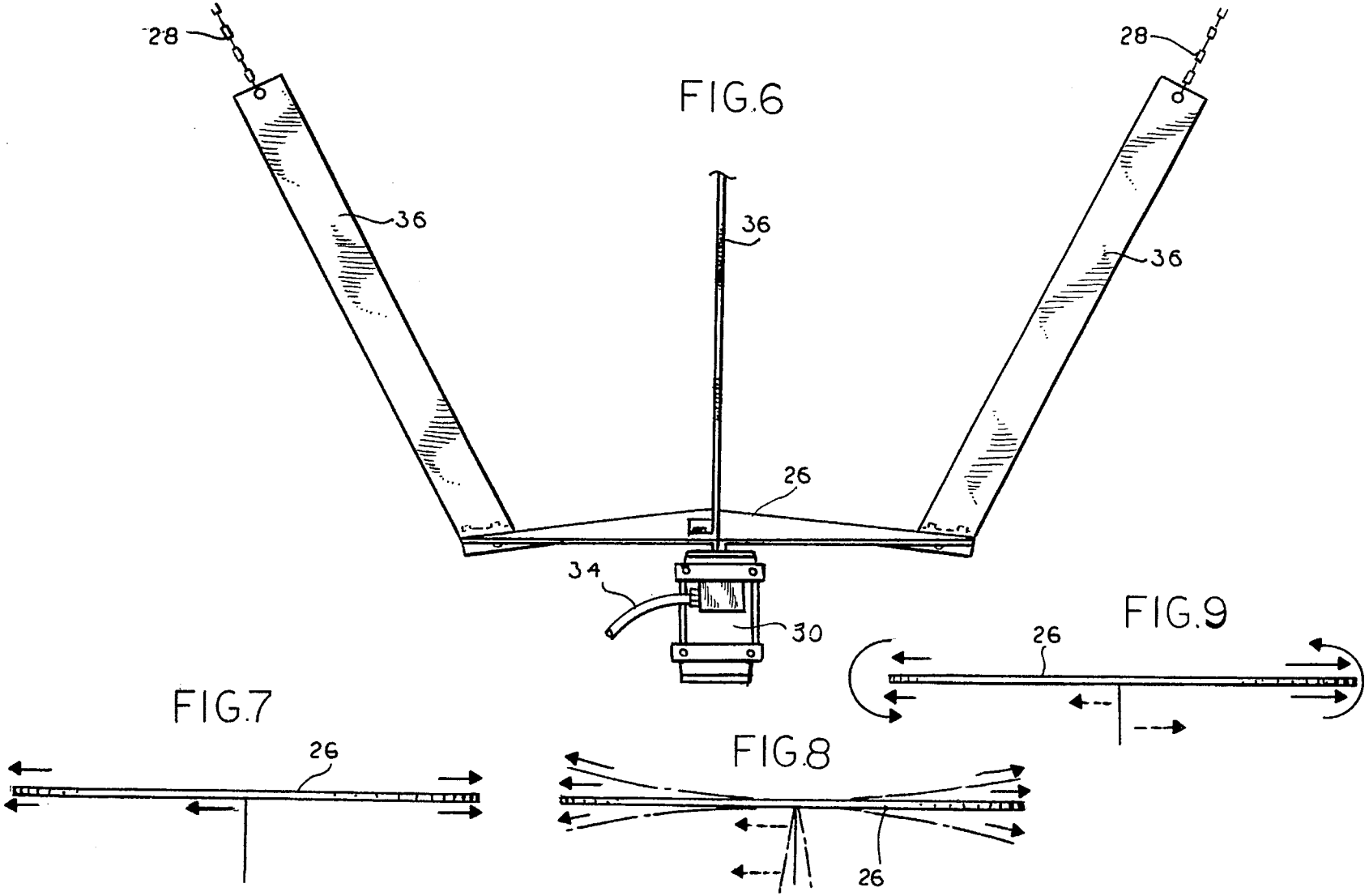
FIG. 6 is an isolated front view of the pre-shaped member and vibrator unit combination held within the storage facility in an alternative manner.
FIGS. 7, 8 and 9 illustrate various oscillation patterns which can be achieved with various operations of the present invention.

Directing attention now to the illustrated embodiment of the vibrator unit 30, it can be seen that rigid attachment, preferably to the underside of the plate member 26 in the low pressure void created thereby, can be by either direct-mount, as shown in FIGS. 1, 3 and 6, or by indirect gusset-mount as illustrated in FIGS. 4 and 5. The vibrator unit 30 is preferably a modified electric motor or turbine device with power provided by means of a flexible conduit 34 entering the hopper 10 in a low pressure void created below the plate 26, such as through the collar 22, with a sealed connector provided.

A preferred method for using the flow facilitation and control system 25 includes the selective operation of the vibrator 30 to oscillate the plate 26 and create moving voids and shock waves in the stored material which promotes an even velocity profile across the hopper 10 and produces a mass flow unloading pattern. Vibration of the plate 26 adds energy to the stored material in the form of pressure waves, increasing the stress which is concentrated at an edge of the plate 26 where crack propagation then begins. Besides minimizing bridging above the discharge port 22 and substantially eliminating the other problems associated with the storage of granular material within the hopper 10, controlled oscillation of the plate 26 further prevents exterior vibration of the bin during unloading, buckled hoppers, obround collars and even total collapse.

Adjustment of upper and lower weights, or eccentrics (not shown), located inside of the vibrator 30 casing can be utilized to selectively tune the oscillation of the plate 26 to promote mass flow in a variety of stored materials. In relatively non-viscous materials, for example, an adjustment of the upper weights in order to tune the horizontal oscillation, as shown in FIG. 7, will generally suffice to promote mass flow. In more viscous materials, however, an added adjustment of the lower weights to provide vertical oscillation, as shown in FIG. 8, and create a swirling motion, as shown in FIG. 9, may also be required.

Vibrator units 30 which can be adjusted as described to produce the oscillation patterns required are commercially available.

Rigid attachment of the vibrator unit 30 to the plate 26 by either direct-mount or gusset-mount eliminates the need for power shafts or linkages which are subject to wear and malfunction. In addition, the rigid attachment of the vibrator 30 to the plate 26, in combination with the provision of power by means of a flexible conduit 34, minimizes self-damping of the combination thereby increasing the energy transmitted to the stored material in the hopper 10.

In addition to the benefits caused by the vibration of the plate 26 as discussed above (which primarily affects the stored grain within approximately two feet, in all directions, from the plate 26), the resultant vibration of the flexible link, or other suitable supports 28 also serves to promote mass flow and prevent bridging. Moreover, by using the alternative embodiment of the invention illustrated in FIG. 6, the vibration of the flexible supports 28 can be further extended upward by providing a substantially rigid member within the otherwise flexible support 28. For example, extending an approximately 30" rigid flat member 36 upward from the plate 26, which therefore forms the lower most portion of the flexible support 28, extends the vibration upward and provides for additional tuning of the system 25. Additional oscillation control can be provided through variation of the design of the gusset plate 40 and/or by relocating the vibrator 30 on the gusset 40. One example of vibrator 30 placement and gusset plate 40 is illustrated in FIGS. 4 and 5, the general effects of which would become apparent to one of ordinary skill in the art and are therefore omitted here.

The invention is claimed as follows:

1. A method of producing a first-in, first-out material flow pattern for unloading a bulk storage facility having a hopper portion terminating at the exhaust port, said method comprising the steps of:

a. suspending a substantially impermeable pre-shaped member at a predetermined height above said exhaust port by providing flexible link members which are connected between the bulk storage facility and the pre-shaped member;

b. operatively coupling a vibrator unit to said pre-shaped member;

c. energizing said vibrator unit to selectively oscillate said pre-shaped member, said oscillation forces created upon operation of the plate vibrator being substantially transmitted to the bulk materials stored within the bulk storage facility and not substantially transmitting said oscillation forces to the bulk storage facility and;

d. utilizing said pre-shaped member to support a central core of said material within said bulk storage facility, and to simultaneously prevent material from wedging between the hopper and the pre-shaped member during unloading of the bulk storage facility through the exhaust port.

2. The method as recited in claim 1, wherein positioning said pre-shaped member comprises suspending said pre-shaped member above said exhaust port with substantially flexible supports.

3. The method as recited in claim 1, wherein operatively coupling said vibrator unit to said pre-shaped member comprises providing a direct attachment.

4. Apparatus for increasing and controlling the flow of bulk materials from a bulk storage receiver being defined in a lower portion thereof by a truncated cone member, said apparatus comprising:

a. a solid plate member suspended horizontally in said storage receiver for supporting the weight of a central core of the bulk materials stored therein, and for creating a low pressure void above a discharge port formed at the truncation of said cone member;

b. flexible link members supporting said plate member and being attached, by way of rigid sheet material sections extending from said plate member to said flexible link members, to said storage receiver above said cone member, and;

c. a plate vibrator rigidly attached to a surface of said plate member for selectively oscillating said plate member and thereby promoting the flow of bulk materials around said plate member and out of said discharge port.

5. Apparatus as recited in claim 4, wherein said rigid sheet material sections are less than or equal to 30" in length.

6. Apparatus for increasing and controlling the flow of bulk materials from a bulk storage receiver being defined in a lower portion thereof by a truncated cone member, said apparatus comprising:

a. a solid plate member suspended horizontally in said storage receiver for supporting the weight of a central core of the bulk materials stored therein, and for creating a low pressure void above a discharge port formed at the truncation of said cone member;

b. flexible link members supporting said plate member and being attached to said storage receiver above said cone member, and;

c. a plate vibrator rigidly attached indirectly to said member by means of a gusset plate for selectively oscillating said plate member and thereby promoting the flow of bulk materials around said plate member and out of said discharge port.

7. Apparatus for increasing and controlling the flow of bulk materials from a bulk storage receiver being defined in a lower portion thereof by a truncated cone member, said apparatus comprising:

a. a solid plate member suspended horizontally in said storage receiver for supporting the weight of a central core of the bulk materials stored therein, and for creating a low pressure void above a discharge port formed at the truncation of said cone member;

b. flexible link members supporting said plate member and being attached to said storage receiver above said cone member;

c. a plate vibrator rigidly attached to a surface of said plate member for selectively oscillating said plate member and thereby promoting the flow of bulk materials around said plate member and out of said discharge port, and;

d. wherein said plate vibrator can be adjusted, by means of adjustable weights located inside a casing surrounding said plate vibrator, to vary the horizontal oscillation imparted to said plate member upon operation of said plate vibrator.

8. Apparatus for facilitating, promoting and regulating the flow of stored particulate material within a bulk storage facility, and also controlling the flow out of a bulk storage facility, said apparatus comprising: a substantially impermeable pre-shaped member suspended within said bulk storage facility in a substantially horizontal orientation above a discharge port, said pre-shaped member comprising a substantially solid plate having a limited shallow angle with respect to its horizontal orientation rising from an edge of the plate to a central apex such that the weight of a central core of the stored material is supported on an upper surface of the plate defined by the shallow angle, and such that the stored particulate matter will not become wedged between the plate and a surrounding wall of said bulk storage facility upon material flow through said discharge port, a vibrator unit operatively connected to said pre-shaped member, a power source for energizing said vibrator unit and oscillating said pre-shaped member thereby creating voids and shock waves within the stored material to produce a mass flow unloading pattern, and flexible link members suspending said pre-shaped member within said storage facility, said pre-shaped member and said flexible link members substantially transmitting the oscillation forces created upon operation of the vibrator unit to the stored material stored in the bulk storage facility and not substantially transmitting said oscillation forces to the bulk storage facility.

9. Apparatus as recited in claim 8, wherein said vibrator unit is directly coupled to said pre-shaped member to optimize oscillatory force transmission.

10. Apparatus as recited in claim 8, wherein said vibrator unit is coupled to a bottom surface of said pre-shaped member and located between said pre-shaped member and said discharge port in a low-pressure area created within said bulk storage facility by said pre-shaped member.

11. Apparatus as recited in claim 8, wherein said flexible link members are in the form of pure tension members.

12. Apparatus as recited in claim 8, wherein said pre-shaped member is held within said bulk storage facility so as to remain naturally centered over said discharge port.

13. Apparatus as recited in claim 8, wherein said vibrator unit includes adjustment means for creating varying oscillation patterns.

14. Apparatus as recited in claim 8, wherein said power source is an electric motor having a power cord entering said bulk storage facility in an area of reduced pressure created below said pre-shaped member.

15. Apparatus as recited in claim 8, wherein said stored particulate matter comprises granular material having an angle of repose in the range of 10°–45°.

16. Apparatus for increasing and better regulating the flow pattern of bulk materials within a storage receiver, and better controlling the flow of bulk materials being discharged from a bulk storage receiver, said receiver being defined in a lower portion thereof by a truncated cone member, said apparatus comprising:

a. a solid plate member having a limited shallow angle with respect to the horizontal and rising toward an upper portion of said receiver from a continuous edge of the plate member to an apex thereof, said plate being suspended horizontally in said storage receiver for supporting the weight of a central core of the bulk materials stored therein, and for minimizing the possibility of material becoming wedged between the plate member and the lower truncated cone member portion of the receiver and thereby creating a low pressure void above a discharge port formed at the truncation of said cone member;

b. flexible link members suspending said plate member in said storage receiver and being attached to said storage receiver above said cone member, and;

c. a plate vibrator rigidly attached to a surface of said plate member for selectively oscillating said plate member and thereby promoting the flow of bulk materials around said plate member and out of said discharge port, said plate member and said flexible link members substantially transmitting the oscillation forces created upon operation of the plate vibrator to the bulk materials stored within the bulk storage receiver and not substantially transmitting said oscillation forces to the bulk storage receiver.

17. Apparatus as recited in claim 16, wherein said angle of said plate member is between 0°–40° with respect to the horizontal.

18. Apparatus as recited in claim 16, wherein said flexible link members supporting said plate member are in the form of pure tension members.

19. Apparatus as recited in claim 16, wherein said flexible link members are attached to an upper surface of said plate member and suspend said plate member within said bulk storage receiver from above said lower portion of said bulk storage receiver such that said plate member remains naturally centered over said discharge port at a predetermined height thereabove.

20. Apparatus as recited in claim 8, wherein a diameter of said plate member suspended in said storage receiver is less than or equal to 35% of a maximum diameter of said storage receiver.

21. Apparatus as recited in claim 16, wherein said plate member is suspended in said storage receiver at a predetermined distance above said discharge port such that the area of said plate member is equal to an annular area formed around said plate member and bounded by a wall of said truncated cone member forming said lower portion of said bulk storage receiver.

22. Apparatus as recited in claim 16, wherein said plate member is suspended in said storage receiver at a predetermined distance above said discharge port such that the area of said plate member is within 25% of an annular area formed around said plate member and bounded by a wall of said truncated cone member forming said lower portion of said bulk storage receiver.

23. Apparatus as recited in claim 16, wherein said flexible link members are held at an angle slightly steeper than an angle that said truncated cone portion of said bulk storage receiver forms with the horizontal.

24. Apparatus as recited in claim 16, wherein said plate vibrator is energized by a remote power source and a transmission line coupling said plate vibrator with said remote source enters and exits said bulk storage receiver in an area of reduced pressure formed below said plate member suspended in said receiver.

25. Apparatus as recited in claim 16, wherein said plate vibrator is rigidly attached directly to said plate member.

26. Apparatus as recited in claim 16, wherein said plate vibrator is rigidly attached indirectly to said plate member by means of a gusset plate.

27. Apparatus as recited in claim 16, wherein said plate vibrator includes means for varying both horizontal and vertical oscillations imported to said plate member.

28. Apparatus as recited in claim 16, wherein said flexible link members indirectly attach to said plate member by way of rigid sheet material sections extending from said plate member to said flexible link members in order to extend the effect of said plate vibrator into the granular material stored in said bulk storage facility.

29. Apparatus as recited in claim 28, wherein said rigid sheet material sections are less than or equal to 30" in length.

30. Apparatus as recited in claim 16, wherein said plate vibrator includes means for varying the horizontal oscillations imparted to said plate member upon operation of said plate vibrator.

31. Apparatus as recited in claim 30, wherein said means for varying the horizontal oscillations imparted to said plate member is in the form of adjustable weights located inside a casing surrounding said plate vibrator.

* * * * *